United States Patent [19]

Riblet

[11] 4,058,780

[45] Nov. 15, 1977

[54] WAVEGUIDE CIRCULATOR

[75] Inventor: Gordon Riblet, Wellesley, Mass.

[73] Assignee: Microwave Development Labs., Inc., Needham Heights, Mass.

[21] Appl. No.: 710,893

[22] Filed: Aug. 2, 1976

[51] Int. Cl.[2] ..... H01P 1/38

[52] U.S. Cl. ..... 333/1.1; 333/9

[58] Field of Search ..... 333/1.1

[56] References Cited

U.S. PATENT DOCUMENTS 3,231,835 1/1966 Nielsen et al. ..... 333/1.1

*Primary Examiner*—Paul L. Gensler

*Attorney, Agent, or Firm*—Wolf, Greenfield & Sacks

[57] ABSTRACT

A three-port waveguide circulator has three waveguide arms which meet at a common junction. A transformer step in the form of a Y-shaped ridge is disposed symmetrically at the common junction. This waveguide ridge step preferably supports a quarterwave gyromagnetic element. The step may be formed by cutting slots from a standard transformer step to form the ridge. The resulting ridge structure is of reduced size including reduced length compared to a standard uniform transformer section which is advantageous for certain applications such as in constructing a four-port circulator as disclosed herein. A double ridge step may also be used.

12 Claims, 5 Drawing Figures

WAVEGUIDE CIRCULATOR

BACKGROUND OF THE INVENTION

The present invention relates in general to circulators for the non-reciprocal transmission of electro-magnetic energy. More particularly, the invention pertains to improved Y-junction waveguide circulators.

The conventional three-port waveguide circulator employs three waveguide arms that are arranged at angles of 120° with respect to one another and meet at a common junction. One or more gyromagnetic members may be centrally disposed at the junction on a transformer plate or step. These gyromagnetic members are for producing non-reciprocal circulation. The quarter wavelength transformer extending from the boundary of the gyromagnetic material to the step or junction is usually required to improve the performance over a given frequency band. U.S. Pat. No. 3,886,497 shows one such waveguide circulator that comprises a transformer plate symmetrically disposed at the junction and extending across each of the arms of the circulator. These prior art circulators have some operating limitations associated therewith. For example they may not have a sufficiently high performance within a conventional band. Also, these prior art circulators are limited dimensionally and cannot be constructed in smaller sizes.

Accordingly, one object of the present invention is to provide a Y-junction microwave circulator that is characterized by an improved broadband response.

Another object of the present invention is to provide an improved microwave circulator in accordance with the principles of this invention and which is characterized by an improved return loss. This improved return loss may be on the order of 4–5 db for a 10%–15% band.

A further object of the present invention is to provide a three-port microwave circulator that is generally smaller in size than prior art circulators and in particular where the length of the arms of the circulator can be reduced in size with the construction according to this invention.

Still a further object of the present invention is to provide a means for constructing a four-port circulator of reduced overall size.

Analogous coaxial devices employ Uniform TEM mode transmission line transformers and are characterized by bandwidths of up to 50% or even octave bandwidths. However, the typical waveguide circular such as shown in U.S. Pat. No. 3,886,497, has a narrower bandwidth typically between 10%–20% for 20 dB return loss when matched with a standard single step transformer. In comparing the performance of this invention with a typical circulator, for a given performance level of say 20dB return loss the bandwidth will be larger with the device of this invention. Analogously, for a given bandwidth the performance level with the device of this invention is higher by 4–5dB.

Accordingly, another object of this invention is to provide an improved waveguide circulator that displays bandwidth characteristics more nearly like a coaxial circulator by employing a transformer more nearly like a TEM mode transmission line transformer.

SUMMARY OF THE INVENTION

The present invention is concerned with an improved construction for a three-port waveguide circulator. This circulator comprises three waveguide arms meeting at a common junction and a Y-shaped ridge symmetrically disposed at the common junction and having ridge sections extending along each arm with the ridge sections each being narrower than the wider dimension of the waveguide arm. Each of the ridge cross sections is defined by equal width slots between either side of the ridge section and respective walls of the wavelength arm. With the ridge construction of this invention it is preferred that the widths of the slots be equal and be selected to provide a minimum low frequency cut-off frequency for the transformer sections. By lowering the cut-off frequency a broader band of operation is possible at the same center frequency in comparison to known waveguide circulators. In addition, the device of this invention can be constructed more compactly in that the length of each ridge is smaller in comparison with a conventional transformer step typically used in a waveguide circulator. The height of the ridge is also reduced in comparison with the height of a typical transformer step. In accordance with the invention either a single ridge or a double ridge structure can be used. With a double ridge transformer there are essentially two facing Y-shaped ridges extending respectively from the top and bottom walls defining the circulator. A four-port circulator can be constructed in accordance with this invention by combining two three-port circulators with a reduced overall size being realized by application of the principles of this invention.

BRIEF DESCRIPTION OF THE DRAWINGS

Numerous other objects, features and advantages of the invention should now become apparent upon a reading of the following detailed description taken in conjunction with the accompanying drawings, in which.

DETAILED DESCRIPTION

Figure 1:
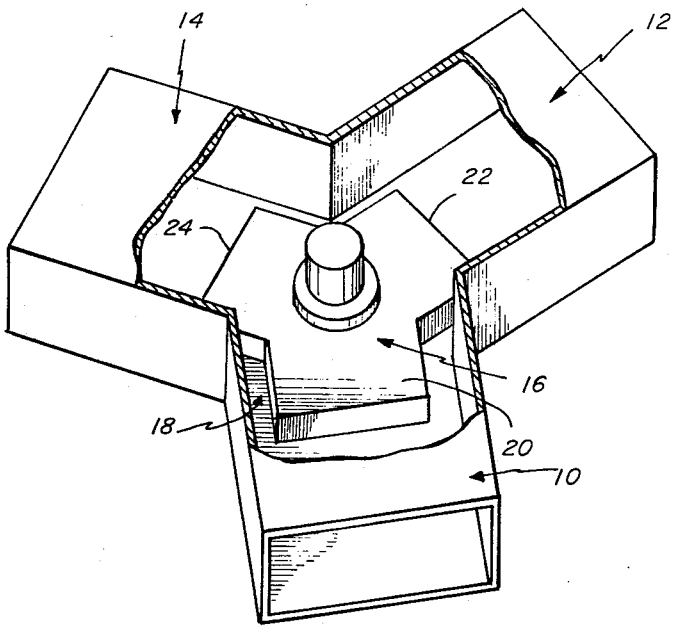
FIG. 1 is a perspective view of the circulator of this invention with a top wall partially cut away to expose the internal structure of the circulator.
Figure 2:
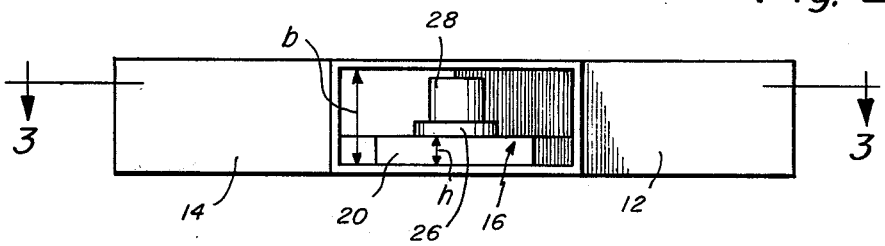
FIG. 2 is a front view looking into one of the arms of the circulator.
Figure 3:
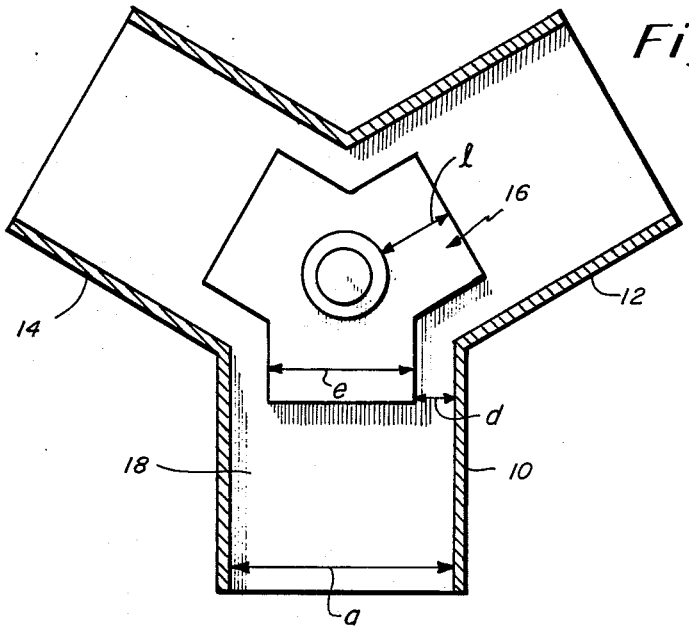
FIG. 3 is a cross sectional view taken along lines 3—3 of FIG. 2.

FIGS. 1–3 show a Y-junction waveguide circulator having three waveguide arms 10, 12 and 14 all of which meet at a common junction. A Y-shaped ridge structure 16 is disposed at the common junction and is preferably integrally formed with the base wall 18 of the circulator. The circulator can be constructed in two halves including a top half and a bottom half which may be suitable secured together such as by bolting or brazing. The Y-shaped ridge structure comprises ridge segments 20, 22 and 24 which are disposed symmetrically with respect of the arms 10, 12 and 14. FIG. 2 shows the ridge segment 20 extending within the circulator arm 10 and in effect forming a ridge in a length of rectangular waveguide. This ridge structure has been found to provide improved performance in comparison to the circulator of the type shown in U.S. Pat. No. 3,886,497.

A conductive pedestal 26 is centrally disposed in the structure 16 and is for supporting a gyromagnetic disc 28. This disc is constructed of a material such as ferrite or garnet exhibiting gyromagnetic properties. See U.S.

Pat. No. 3,886,497 for further particulars regarding the selection of the gyromagnetic disc 28.

FIGS. 2 and 3 show some of the more important dimensions that are dealt with in constructing an embodiment of this invention. These dimensions include the height $h$ of the ridge structure 16 (FIG. 2), the length $l$ of each ridge segment (FIG. 3), and the slot width $d$ (FIG. 3) measured between each ridge segment and an outer wall defining the circulator as shown clearly in FIG. 3. The embodiment shown in FIGS. 1–3 may be constructed using WR-90 waveguide arms having dimensions $a = 0.900$ inch and $b = 0.400$ inch. Each of the arms of the circulator is preferably constructed using the same WR-90 structure.

The dimension $d$ of the slot width defined by the ridge segment as shown in FIG. 3 may be determined empirically so as to provide as low a cut-off frequency as is possible, thereby providng a higher performance device. The ideal is a cut-off frequency of zero as for a TEM mode transmission line structure. In this case the characteristic impedance of the transformer section has no frequency dependence. A ridge in the middle of the waveguide structure lowers the cut-off frequency. With a device in accordance with this invention it has been found that for a 10%–15% band the return loss can be improved by 4–5 db in comparison with a conventional waveguide circulator.

Figure 5:
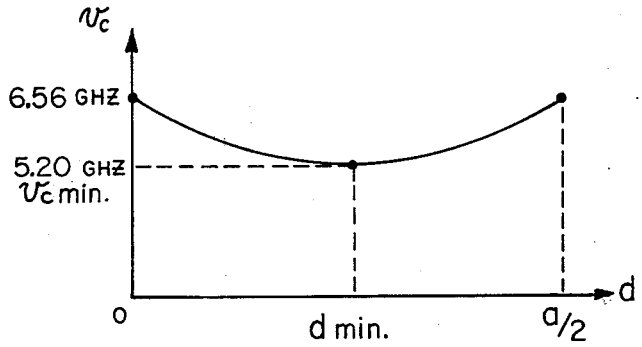
FIG. 5 is a graph associated with the circulator of this invention shown in FIGS. 1–3.

FIG. 5 shows a graph that is obtained by calculating the low frequency cut-off frequency using the transverse resonance method with different slot widths $d$. The curve shown in FIG. 5 indicates that the cut-off frequency $\nu_c$ is at a maximum when there is essentially no slot, i.e. there is no ridge structure but there is instead a conventional transformer step plate. Also, when the slot width becomes large and the ridge segment becomes rather narrow, the cut-off frequency also increases to this same value as is clearly shown in FIG. 5. Between these two extremes the cut-off frequency reaches a minimum value and has associated therewith a corresponding dimension $d_{min}$ which in this case is approximately 0.200 inch.

Referring again to FIG. 5, if the dimension $a = 0.900$ inch then the dimension $a/2$ =00.450 inch. The dimension $d = 0.200$ inch is thus slightly less than one-half of the dimension $a/2$ which is consistent with the graph shown in FIG. 5.

Actually, it has been found that the slot width $d$ is preferably equal to or less than the ridge segment width dimension $e$. For example, in the previously stated example the width may vary from $d = 0.100$ inch to 0.300 inch. If the dimension $d$ is 0.300 inch then likewise the dimension $e$ is also 0.300 inch. In comparing the dimensions $d$ and $a$ a ratio can be stated for the width $d$. The dimension $d$ should be in the range of 10%–35% of dimension $a$. From FIG. 5 it should be apparent that because of the relative flatness of the curve about a minimum cut-off frequency value there is actually a reasonable range over which the dimension $d$ provides satisfactory results.

With a WR-90 waveguide one operating band width is from 8.5 GHZ to 9.6 GHZ. With a conventional transformer step circulator such as shown in U.S. Pat. No. 3,886,497 the cut-off frequency is 6.56 GHZ. As is shown in FIG. 5 the minimum cut-off frequency obtainable by the structure of the present invention is reduced to a value of approximately 5.20 GHZ. The change in the cut-off frequency is used as disclosed hereinafter for calculating the dimensions $l$ and $h$ shown in FIGS. 2 and 3.

Both dimensions $l$ and $h$ are determined primarily by reducing these dimensions from the dimensions of a standard transformer step used in a prior art circulator. For example, the dimension $l$ in a prior art circulator employing a standard transformer step is 0.390 inch. The dimension $l$ shown in FIG. 3 in accordance with this invention is reduced from the length of the standard transformer step by approximately the ratio of:

$$\lambda'_g/\lambda_g;$$

where $\lambda_g'$ = guide wavelength of ridge transformer, $\lambda_g$= guide wavelength of standard transformer, $$\lambda'_g = \frac{\lambda}{\sqrt{1-\left(\frac{\nu'_c}{\nu}\right)^2}} \text{ and } \lambda_g = \frac{\lambda}{\sqrt{1-\left(\frac{\nu_c}{\nu}\right)^2}}$$

By making the proper substitutions it can be stated that:

$$\simeq \frac{\sqrt{1-\left(\frac{\nu_c}{\nu}\right)^2}}{\sqrt{1-\left(\frac{\nu'_c}{\nu}\right)^2}}$$

$\nu$ = midband frequency, $\nu_c$ = cutoff frequency of standard transformer, and $\nu'_c$ = cutoff frequency with ridge transformer.

From the previous example using WR-90 arms, $\nu$ = 9.05 GHZ, $\nu_c$ = 6.56 GHZ, and $\nu'_c$ = 5.20 GHZ. Again, by substitution of these values the length is shortened by:

$$\frac{\sqrt{1-.53}}{\sqrt{1-.33}} = 0.84$$

If the length with the standard transformer is 0.390 inch then the length $l$ = in FIG. 3 is:

$$l = 0.84\ (0.290 \text{ inch})$$

$$l = 0.327 \text{ inch}$$

It is found that the dimension $h$ shown in FIG. 2 is also controlled by the same relationships that control the dimension $l$. Thus, assuming the same frequency values, the height of the step is reduced by the factor 0.84 from the standard step of 0.200 inch in order to maintain the same impedance level for matching into that of the gyromagnetic medium. The height $h$ is therefore:

$$h = 0.200 \text{ inch } (0.84)$$

$$h = 0.168 \text{ inch}$$

The dimensions $h$ and $l$ are reduced from the like dimensions of a standard transformer step by a maximum on the order of 25%.

Figure 4:
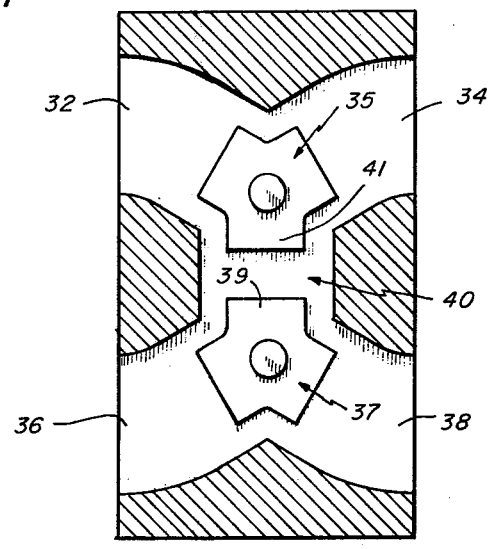
FIG. 4 is a cross sectional view similar to that shown in FIG. 3 but in the construction of a four-port circulator.

FIG. 4 shows a view similar to that shown in FIG. 3 and employing two three-part circulators combined together. In FIG. 4 there are four ports 32, 34, 36 and 38, and two ridge transformer structures 35 and 37. Each of the openings of the ports may be of a size to fit with a standard section of waveguides such as WR-90 guide. The ports shown in FIG. 4 are somewhat different in shape than those shown in the first embodiment of FIGS. 1–3 wherein the walls defining the ports in FIG. 4 are arcuate or curved in shape as shown in my copending application Ser. No. 614,449 filed Sept. 18, 1975 now U.S. Pat. No. 4,007,903 issued Feb. 15, 1977.

In FIG. 4 there is also what may be termed an interconnecting port 40. Note that the ridge section 41 is in facing relationship with the ridge section 39.

With prior art structures of the type using a standard transformer step there is a limitation on the minimum distance between, for example, the ports 32 and 36. Because in accordance with the present invention the length of the segments 39 and 41 is shorter than with prior art structures, it follows that the ports 32 and 36 can be disposed at a closer relative relationship. In this way, of course, the entire device can be made smaller which is necessary for certain applications.

Having described a limited number of embodiments of this invention it should now become apparent to those skilled in the art that there are numerous modifications that can be made in these embodiments and that all such modifications are contemplated as falling within the scope of the present invention as defined by the appended claims. For example, FIGS. 1–3 disclose a waveguide circulator employing a single ridge structure in accordance with this invention. A double ridge structure may also be used in accordance with the invention. In that case the dimension $d$ is calculated in the same manner for each of the ridge structures as explained hereinbefore. The other dimensions $l$ and $h$ are also reduced in a similar manner but they are reduced in comparison with the known dimensions of a double step transformer.

What is claimed is:

1. A three-port waveguide circulator comprising:
three waveguide arms meeting at a common junction,
a ridge structure mounted on a wall of the waveguide arms at the common junction and having ridge sections extending along each arm with the ridge sections each being narrower than the wider internal dimension of the waveguide arm to thereby define slots between either side of the ridge section and respective narrow walls of each waveguide arm, each said ridge section having a wall segment facing the narrow wall of each waveguide arm and extending substantially parallel to the narrow wall, and a gyromagnetic element disposed at the junction adapted to be biased by a d.c. magnetic field.

2. A three-port waveguide circulator as set forth in claim 1 wherein the ridge structure is symmetrically disposed at the common junction and each ridge section has opposite facing wall segments facing respective narrow walls wherein the wall segments are substantially parallel to respective narrow walls.

3. A three-port waveguide circulator as set forth in claim 2 wherein each slot is of the same width along the length thereof.

4. A three-port waveguide circulator as set forth in claim 3 wherein the slots on either side of the ridge section are of like width.

5. A three-port waveguide circulator as set forth in claim 2 wherein each slot has a width of at least 10% of the waveguide arm wide dimension.

6. A three-port waveguide circulator as set forth in claim 5 wherein the slot width $d$ is in the range of 10%–35% of the wider arm dimension $a$.

7. A three-port waveguide circulator as set forth in claim 2 wherein the height $h$ of each ridge section is reduced from a standard transformer step height by the ratio:

$$\frac{\sqrt{1-\left(\frac{\nu_c}{\nu}\right)^2}}{\sqrt{1-\left(\frac{\nu'_c}{\nu}\right)^2}}$$

where
$\nu$ = midband frequency,
$\nu_c$ = cut-off frequency of standard transformer, and
$\nu'_c$ = cut-off frequency with ridge transformer, 8. A three-port waveguide circulator comprising:
three waveguide arms meeting at a common junction,
a ridge structure mounted on a wall of the waveguide arms at the common junction and having ridge sections extending along each arm with the ridge sections each being narrower than the wider internal dimension of the waveguide arm to thereby define slots between either side of the ridge section and respective narrow walls of each waveguide arm, each said ridge section having sidewalls facing the narrow wall and of each waveguide arm, and an end wall substantially perpendicular to said sidewalls and extending transversely in a direction extending between the narrow walls of the waveguide arm,
and a gyromagnetic element disposed at the junction adapted to be biased by a d.c. magnetic field.

9. A three-port waveguide circulator as set forth in claim 8 wherein said end wall extends across a major length between narrow walls of the waveguide arm.

10. A three-port waveguide circulator as set forth in claim 8 wherein each slot has a width of at least 10% of the waveguide arm wide dimension.

11. A three-port waveguide circulator as set forth in claim 10 wherein the slot width $d$ is in the range of 10%–35% of the wider arm dimension $a$.

12. A three-port waveguide circulator as set forth in claim 8 wherein the height $h$ of each ridge section is reduced from a standard transformer step height by the ratio:

$$\frac{\sqrt{1-\left(\frac{\nu_c}{\nu}\right)^2}}{\sqrt{1-\left(\frac{\nu'_c}{\nu}\right)^2}}$$

where $\nu$ = midband frequency,
$\nu_c$ = cut-off frequency of standard transformer, and
$\nu'_c$ = cut-off frequency with ridge transformer.

* * * * *